US011603278B2

(12) United States Patent
Deno

(10) Patent No.: US 11,603,278 B2
(45) Date of Patent: Mar. 14, 2023

(54) SHEET CONTROL FOR IMAGE FORMING APPARATUS

(71) Applicant: CANON KABUSHIKI KAISHA, Tokyo (JP)

(72) Inventor: Kohei Deno, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 729 days.

(21) Appl. No.: 16/571,352

(22) Filed: Sep. 16, 2019

(65) Prior Publication Data

US 2020/0024093 A1 Jan. 23, 2020

Related U.S. Application Data

(62) Division of application No. 15/425,126, filed on Feb. 6, 2017, now Pat. No. 10,442,645.

(30) Foreign Application Priority Data

Feb. 16, 2016 (JP) ..... 2016-027455

(51) Int. Cl.
*B65H 9/10* (2006.01)
*B65H 85/00* (2006.01)
(Continued)

(52) U.S. Cl.
CPC ..... *B65H 9/106* (2013.01); *B65H 7/10* (2013.01); *B65H 7/14* (2013.01); *B65H 9/006* (2013.01);
(Continued)

(58) Field of Classification Search
CPC ..... G03G 15/6567; G03G 15/6561; G03G 15/234; G03G 15/6564
See application file for complete search history.

(56) References Cited

U.S. PATENT DOCUMENTS 7,684,749 B2 3/2010 Yamane et al.
7,848,696 B2 12/2010 Peng et al.
(Continued)

FOREIGN PATENT DOCUMENTS

JP 2009-143643 A 7/2009
JP 2012-056668 A 3/2012
(Continued)

OTHER PUBLICATIONS

Japanese Office Action dated Jan. 14, 2020, in related Japanese Patent Application No. 2016-027455.

*Primary Examiner* — Jessica L Eley
(74) *Attorney, Agent, or Firm* — Venable LLP

(57) ABSTRACT

An image forming apparatus includes a controller to move a sheet, in an image formation process on a first surface, to a standard position in a width direction and move the sheet, in an image formation process on a second surface, in the width direction based on a detected position in a case where a difference between the standard position and a first position in the width direction is equal to or smaller than a predetermined value. The controller moves the sheet, in the image formation process on the first surface, by the predetermined value in the width direction and moves the sheet, in the image formation process on the second surface, in the width direction based on detected positions in a case where the difference between the standard position and the first position in the width direction is larger than the predetermined value.

15 Claims, 11 Drawing Sheets

(51) Int. Cl.

| | |
|---|---|
| ***G03G 15/23*** | (2006.01) |
| ***G03G 15/00*** | (2006.01) |
| ***B65H 7/14*** | (2006.01) |
| ***B65H 9/00*** | (2006.01) |
| ***B65H 7/10*** | (2006.01) |

(52) U.S. Cl.

CPC ..... *B65H 9/103* (2013.01); *B65H 85/00* (2013.01); *G03G 15/235* (2013.01); *G03G 15/6567* (2013.01); *B65H 9/10* (2013.01); *B65H 2404/1424* (2013.01); *B65H 2511/20* (2013.01); *B65H 2511/413* (2013.01); *B65H 2511/512* (2013.01)

(56) References Cited

U.S. PATENT DOCUMENTS

| | | | | |
|---|---|---|---|---|
| 8,348,266 | B2 | 1/2013 | Deno | |
| 8,408,830 | B2 | 4/2013 | Ogata et al. | |
| 8,540,240 | B2 | 9/2013 | Deno et al. | |
| 8,764,008 | B2 | 7/2014 | Otsuki et al. | |
| 9,102,485 | B2 | 8/2015 | Deno | |
| 9,248,979 | B2 | 2/2016 | Sako | |
| 9,581,928 | B2 | 2/2017 | Deno | |
| 10,197,961 | B2 | 2/2019 | Deno | |
| 2007/0264066 | A1* | 11/2007 | Peng | G03G 15/5062 399/395 |
| 2009/0154975 | A1 | 6/2009 | Ogata et al. | |
| 2009/0304429 | A1 | 12/2009 | Makinodan | |
| 2011/0194860 | A1* | 8/2011 | Peng | G03G 15/6564 399/72 |
| 2012/0075681 | A1* | 3/2012 | Inoue | G03G 15/6561 358/498 |
| 2012/0207485 | A1* | 8/2012 | Iwakawa | G03G 15/0189 399/394 |
| 2017/0235254 | A1 | 8/2017 | Deno | |

FOREIGN PATENT DOCUMENTS

| | | | |
|---|---|---|---|
| JP | 2015-21718 | A | 12/2015 |
| JP | 2015-221718 | A | 12/2015 |

* cited by examiner

SHEET CONTROL FOR IMAGE FORMING APPARATUS

This application is a divisional of application Ser. No. 15/425,126, filed Feb. 6, 2017.

BACKGROUND OF THE INVENTION

Field of the Invention

The present invention relates to an image forming apparatus configured to form an image on a sheet.

Description of the Related Art

Generally, in an image forming apparatus such as a copier, a sheet is sometimes laterally displaced in a width direction of the sheet while being conveyed. In the case where an image is formed on the sheet laterally displaced, the image printed on the sheet is displaced from the center of the sheet. This may be perceived as printing of a poor quality. Therefore, a shifting mechanism that detects the position of an edge portion of the sheet in the width direction and corrects the lateral displacement of the position of the sheet is known.

In Japanese Patent Laid-Open No. 2009-143643, an image forming apparatus that detects the position of an edge portion of a first page sheet in the width direction and corrects the image formation position for a third page sheet on a photoconductor on the basis of the amount of displacement of the edge portion of the first page sheet from a standard position is proposed. This image forming apparatus corrects the image formation position in advance on the basis of the amount of displacement of a sheet of two pages before, and thereby reduces the shift amount of the sheet to improve the image quality and the productivity of the image forming apparatus.

Generally, an image forming apparatus includes an image forming portion configured to form an image, a sheet feed portion configured to feed a sheet, and a duplex conveyance portion configured to convey the sheet on a first surface of which an image has been formed to the image forming portion again for forming images on both surfaces of the sheet. In addition, since the sheet may be skewed when a shifting mechanism shifts the sheet in a width direction in the case where the shift amount of the sheet is too large, an upper limit value of the shift amount is set. It can be considered that the upper limit value of the shift amount of the sheet by the shifting mechanism is set so as to vary depending on which conveyance path the sheet passes through. The upper limit value of the shift amount is set to vary because the length and shape of the conveyance path, arrangement of conveyance rollers in the conveyance path, and the like are different between the sheet feeding portion and the duplex conveyance portion.

Therefore, there is a case where, in an image forming apparatus disclosed in Japanese Patent Laid-Open No. 2009-143643, the shift amount of the sheet exceeds the upper limit value when forming an image on a first surface of the sheet and the shift amount of the sheet becomes equal to or smaller than the upper limit value when forming an image on a second sheet of the sheet. In this case, the precision of alignment of the image formed on the first surface is low, and the precision of alignment of the image formed on the second surface is high. This results in displacement of images between the first surface and the second surface of the sheet. In this way, there has been a difference between the relative positions of the images formed on the first surface and the second surface of the sheet, and this has been problematic for the quality of a printed product.

SUMMARY OF THE INVENTION

According to a first aspect of the present invention, an image forming apparatus including an image forming portion, a moving portion, a re-conveyance portion, a detection portion, and a control portion is provided. The image forming portion is configured to form an image on a sheet that is conveyed. The sheet has a first surface and a second surface. The moving portion is provided upstream of the image forming portion in a conveyance direction of the sheet and is configured to move the sheet in a width direction perpendicular to the conveyance direction while nipping the sheet. The re-conveyance portion is configured to invert the sheet having the image formed on the first surface by the image forming portion such that the first surface and the second surface change places and convey the sheet to the image forming portion again. The detection portion is configured to detect a position of the sheet in the width direction. The control portion is configured to control, based on a detection result of the detection portion, in a case where a center of the image formed on the first surface in the width direction is displaced in the width direction from a center of the sheet in the width direction and an image is to be formed on the second surface of the sheet, the moving portion to move the sheet in the width direction such that the center of the image formed on the first surface in the width direction and a center of the image to be formed on the second surface in the width direction coincide.

According to a second aspect of the present invention, an image forming apparatus including an image forming portion, a moving portion, a re-conveyance portion, a detection portion, and a control portion is provided. The image forming portion is configured to form an image on a sheet that is conveyed. The sheet has a first surface and a second surface. The moving portion is provided upstream of the image forming portion in a conveyance direction of the sheet and is configured to move the sheet in a width direction perpendicular to the conveyance direction while nipping the sheet. The re-conveyance portion is configured to invert the sheet bearing the image formed on the first surface by the image forming portion such that the first surface and the second surface change places and convey the sheet to the image forming portion again. The detection portion is configured to detect an edge position of the sheet in the width direction. The control portion is configured to control, based on a detection result of the detection portion, in a case where an edge position of the first surface of the sheet is displaced in the width direction from a standard position and an image is to be formed on the second surface of the sheet, the moving portion to move the sheet in the width direction such that the edge position of the first surface of the sheet and an edge position of the second surface of the sheet coincide.

Further features of the present invention will become apparent from the following description of exemplary embodiments with reference to the attached drawings.

DESCRIPTION OF THE EMBODIMENTS

Figure 1:
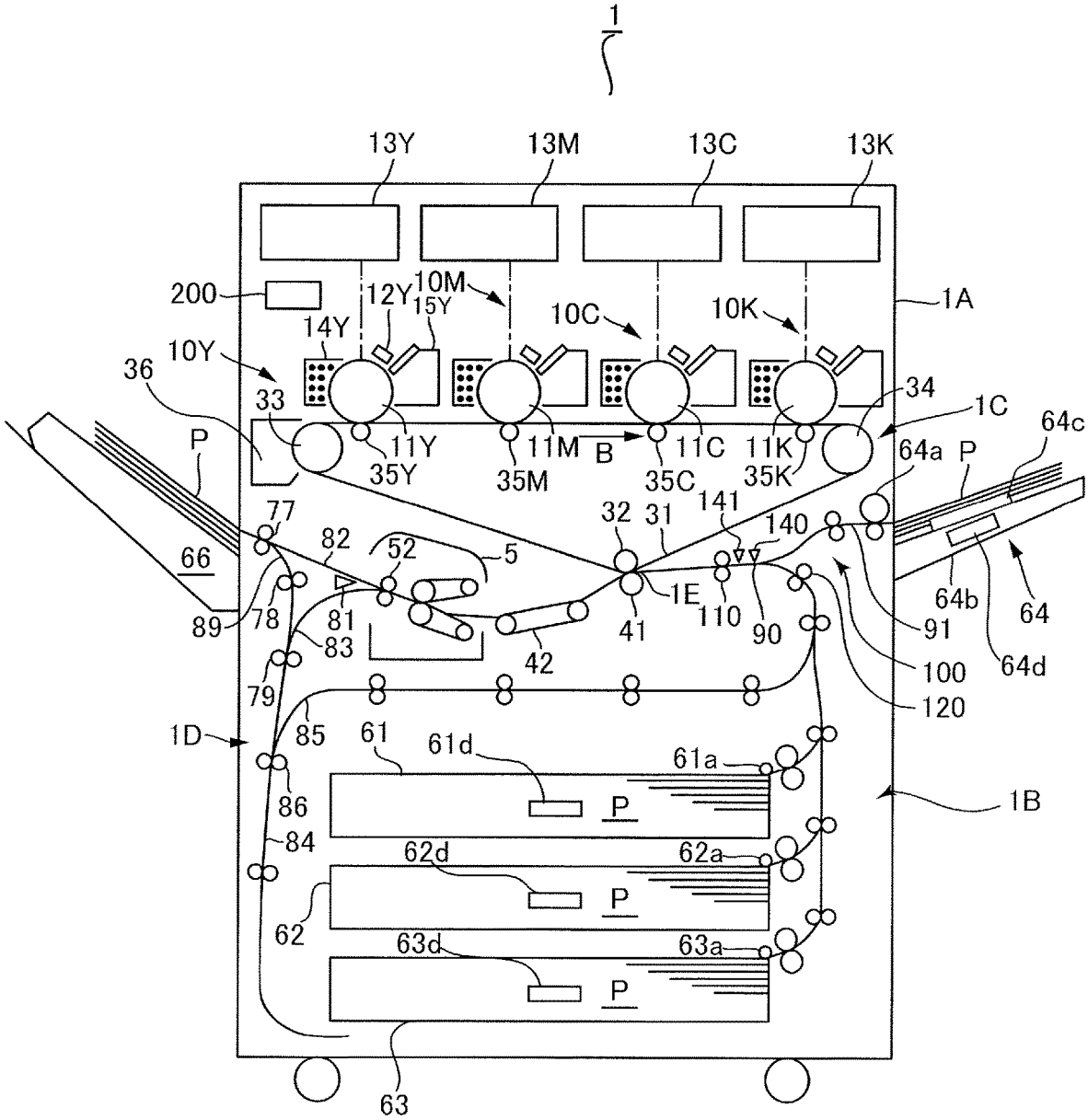
FIG. 1 is an overall schematic view of a printer according to an exemplary embodiment.

First, an exemplary embodiment of the present invention will be described. A printer 1 according to the present exemplary embodiment is an exemplary image forming apparatus and is a laser beam printer that employs an electrophotographic system. As illustrated in FIG. 1, the printer 1 includes a cassette sheet feed portion 1B, a manual sheet feed portion 64, a sheet conveyance unit 100, an image forming portion 1C, a duplex conveyance portion 1D serving as a re-conveyance portion, and a control portion 200.

In the case where an instruction for image formation is input to the printer 1, the image forming portion 1C starts an image formation process on the basis of image information input from, for example, an external computer connected to the printer 1. The image forming portion 1C includes four exposing units 13Y, 13M, 13C, and 13K, four process cartridges 10Y, 10M, 10C, and 10K that respectively form images of four colors of yellow, magenta, cyan, and black, an intermediate transfer belt 31 serving as an image bearing member, and a transfer nip 1E serving as a transfer portion that will be described later. The letters Y, M, C and K respectively correspond to yellow, magenta, cyan, and black. The four process cartridges 10Y, 10M, 10C, and 10K are the same in configuration except for the colors of images to be formed. Thus, only the image formation process of the process cartridge 10Y will be described and descriptions of process cartridges 10M, 10C, and 10K will be omitted.

The exposing unit 13Y emits laser light toward a photosensitive drum 11Y of the process cartridge 10Y on the basis of the input image information. At this time, the photosensitive drum 11Y has been electrified in advance by an electrifier 12Y, and an electrostatic latent image is formed on the photosensitive drum 11Y as a result of being irradiated with the laser light. Then, the electrostatic latent image is developed by a developing unit 14Y, and thereby a yellow toner image is formed on the photosensitive drum 11Y. After the toner image is transferred onto the intermediate transfer belt 31, toner remaining on the photosensitive drum 11Y is collected by a cleaner 15Y.

In a similar manner, toner images of magenta, cyan, and black are formed on respective photosensitive drums of process cartridges 10M, 10C, and 10K. The toner images of respective colors formed on the respective photosensitive drums are transferred onto the intermediate transfer belt 31 by primary transfer rollers 35Y, 35M, 35C, and 35K, and then conveyed to a secondary transfer inner roller 32 by the rotation of the intermediate transfer belt 31. The image formation processes of respective colors are performed at such timings that each toner image is transferred onto the intermediate transfer belt 31 so as to be superimposed on an upstream toner image that has been transferred through primary transfer. The intermediate transfer belt 31 is stretched over a driving roller 33, a tension roller 34, and the secondary transfer inner roller 32, and rotates in an arrow B direction.

In parallel with the image formation process described above, the cassette sheet feed portion 1B or the manual sheet feed portion 64 feeds a sheet P. The cassette sheet feed portion 1B includes a plurality of cassettes. In the present exemplary embodiment, the cassette sheet feed portion 1B includes three cassettes 61, 62, and 63, and pickup rollers 61*a*, 62*a*, and 63*a* each feed a sheet P from corresponding one of the cassettes 61, 62, and 63. The manual sheet feed portion 64 includes a manual feed tray 64*b* that is pivotably supported, and a pair of side regulating plates 64*c* are supported by the manual feed tray 64*b* so as to be movable in the width direction. The pair of side regulating plates 64*c* regulates the movement of a sheet P supported on the manual feed tray 64*b* in the width direction. The sheet P supported on the manual feed tray 64*b* is fed by a pickup roller 64*a*.

The skew and the displacement in the width direction of the sheet P fed by the pickup roller 61*a*, 62*a*, 63*a*, or 64*a* are corrected by the sheet conveyance unit 100 that will be described later. The sheet P is subjected to a predetermined pressurizing force and electrostatic bias at a transfer nip 1E after having passed through the sheet conveyance unit 100, and a full-color toner image on the intermediate transfer belt 31 is thereby transferred onto a first surface of the sheet P. The transfer nip 1E is defined by the secondary transfer inner roller 32 and a secondary transfer outer roller 41. Toner remaining on the intermediate transfer belt 31 is collected by a cleaner 36.

After the toner image is transferred onto the sheet P, the sheet P is conveyed to a fixing unit 5 by an air-attraction belt 42 and subjected to a predetermined pressurizing force and heat, and the toner image is thereby melted and fixed. After the sheet P passes through the fixing unit 5, the sheet P is conveyed, by a fixing conveyance roller pair 52, to a discharge conveyance path 82 in the case where the sheet P is to be directly discharged onto a discharge tray 66, and is conveyed to an inversion guidance path 83 in the case where images are to be formed on both surfaces of the sheet P or the like.

A guide member 81 is pivotably provided in a branch portion of the discharge conveyance path 82 and the inversion guidance path 83. The guide member 81 is provided for switching paths in accordance with switching between a discharge mode, an inversion discharge mode, and a re-conveyance mode. In the discharge mode, the sheet P is discharged onto the discharge tray 66. In the inversion discharge mode, the sheet P is discharged after being inverted. In the re-conveyance mode, the sheet P is conveyed to the image forming portion 1C again. The paths are switched by the guide member 81 in accordance with a set mode, and the sheet P is conveyed to the discharge conveyance path 82 or the inversion guidance path 83 according to the set mode.

For example, in the case where the discharge mode is set, the guide member 81 pivots downward and moves to a discharge position at which the guide member 81 guides the sheet P to be discharged. As a result of this, the sheet P conveyed by the fixing conveyance roller pair 52 is conveyed to the discharge conveyance path 82 along an upper surface of the guide member 81, and is discharged onto the discharge tray 66 by a discharge roller pair 77.

In the case where the re-conveyance mode is set, the guide member 81 pivots upward and moves to a drawing-in position at which the guide member 81 guides the sheet P to the inversion guidance path 83. As a result of this, the sheet P conveyed by the fixing conveyance roller pair 52 is guided to the inversion guidance path 83 along a lower surface of the guide member 81, and is drawn into a switchback path 84 by a first inversion roller pair 79. Then, the sheet P is inverted, by a switchback operation of reversing the rotation direction of a second inversion roller pair 86, such that the leading and trailing ends of the sheet P change places, and is conveyed to a duplex conveyance path 85. After this, the sheet P conveyed to the duplex conveyance path 85 is conveyed to the transfer nip 1E through the sheet conveyance unit 100. The duplex conveyance portion 1D includes the inversion guidance path 83, the switchback path 84, the duplex conveyance path 85, the first inversion roller pair 79, the second inversion roller pair 86, and another conveyance roller pair. To be noted, the image formation process for a back surface to be performed after this is the same as the image formation process for a front surface that has been already described. The front surface and the back surface respectively serve as a first surface and a second surface.

In the case where the inversion discharge mode is set, the guide member 81 pivots upward and moves to the drawing-in position. As a result of this, the sheet P is conveyed to the inversion guidance path 83 by the fixing conveyance roller pair 52, and is drawn into the switchback path 84 by the first inversion roller pair 79. Then, the sheet P is inverted, by a switchback operation of reversing the rotation direction of the first inversion roller pair 79, such that the leading and trailing ends of the sheet P change places, and is conveyed to the inversion conveyance path 89. After this, the sheet P is conveyed to the discharge roller pair 77 by an inversion conveyance roller pair 78 provided in the inversion conveyance path 89, and is discharged onto the discharge tray 66 by the discharge roller pair 77. The following description will be given on the premise that the printer 1 according to the present exemplary embodiment exemplarily employs a center-standard sheet conveyance system in which a sheet is conveyed such that the center of a sheet conveyance path in the width direction perpendicular to the sheet conveyance direction matches the center of the sheet in the width direction.

The cassettes 61, 62, and 63 are respectively provided with size detection mechanisms 61*d*, 62*d*, and 63*d* that each detect the size of a sheet P housed in the corresponding cassette. The size detection mechanisms 61*d*, 62*d*, and 63*d* are the same in configuration, and thus only the description of the size detection mechanism 61*d* provided for the cassette 61 will be given and the description of the other size detection mechanisms will be omitted.

The size detection mechanism 61*d* includes a side restriction plate and a size detection lever that are not illustrated. The side restriction plate restricts the position of the sheet P in the width direction. The size detection lever is pivotable, and is slidably in contact with and moves together with the side restriction plate. The side restriction plate is movable in accordance with a side edge portion of the sheet P. The size detection lever is configured to pivot in accordance with the movement of the side restriction plate in the case where the side restriction plate is moved in accordance with the side edge portion of the sheet P.

The size detection mechanism 61*d* includes plural sensors or switches that are capable of detecting the position of the size detection lever in a state where the cassette 61 is attached to a printer body 1A. That is, in the case where the cassette 61 is attached to the printer body 1A, the size detection lever selectively turns detection elements of the sensors or switches on or off. As a result of this, the printer 1 receives a signal of a pattern varying depending on the sheet P housed in the cassette 61 output by the sensors or switches. The printer 1 is capable of recognizing the size or the like of the sheet P housed in the cassette 61 on the basis of the received signal.

The size detection mechanism 61*d* also detects attachment and detachment of the cassette 61. For example, in the case where the cassette 61 is detached, all of the detection elements of the sensors or switches are turned off due to the state of the size detection lever. In the present exemplary embodiment, a size detection mechanism 64*d* similar to the size detection mechanism 61*d* is also provided in the manual sheet feed portion 64.

The side restriction plate is provided for suppressing the skew and displacement in the width direction of the sheet P occurring at the time of feeding the sheet P and at conveyance rollers provided downstream of the pickup rollers. Practically, however, there may be a case where a little gap is present between the side restriction plate and the sheet P. This gap may cause the skew or the displacement in the width direction of the sheet P at the time of feeding or conveying the sheet P.

In this way, it is generally the case that, when setting a sheet P in the cassette 61, 62, or 63, the position of the center of the sheet P is displaced to the front or the back of the cassette 61, 62, or 63 due to the deterioration of the side restriction plate, vibration generated by insertion or drawing out of the cassette 61, 62, or 63, or the like. Moreover, there is a case where the dimensions of the sheet P are slightly different from the designed size. In this case, the sheet P remains offset by a certain constant value with respect to a standard position such as the center of the sheet conveyance path 90.

In an image forming apparatus according to a comparative embodiment that will be described later, control is performed such that the sheet P is shifted in the width direction by the same amount as the constant value described above. This means that the sheet P is shifted by a large amount. In addition, there is a case where the sheet P fed from a cassette is skewed while being conveyed, and is conveyed in a state of being skewed and also shifted in the width direction. To avoid such a state, skew correction or the like is performed by the sheet conveyance unit 100. This point will be described below in detail.

Figure 2:
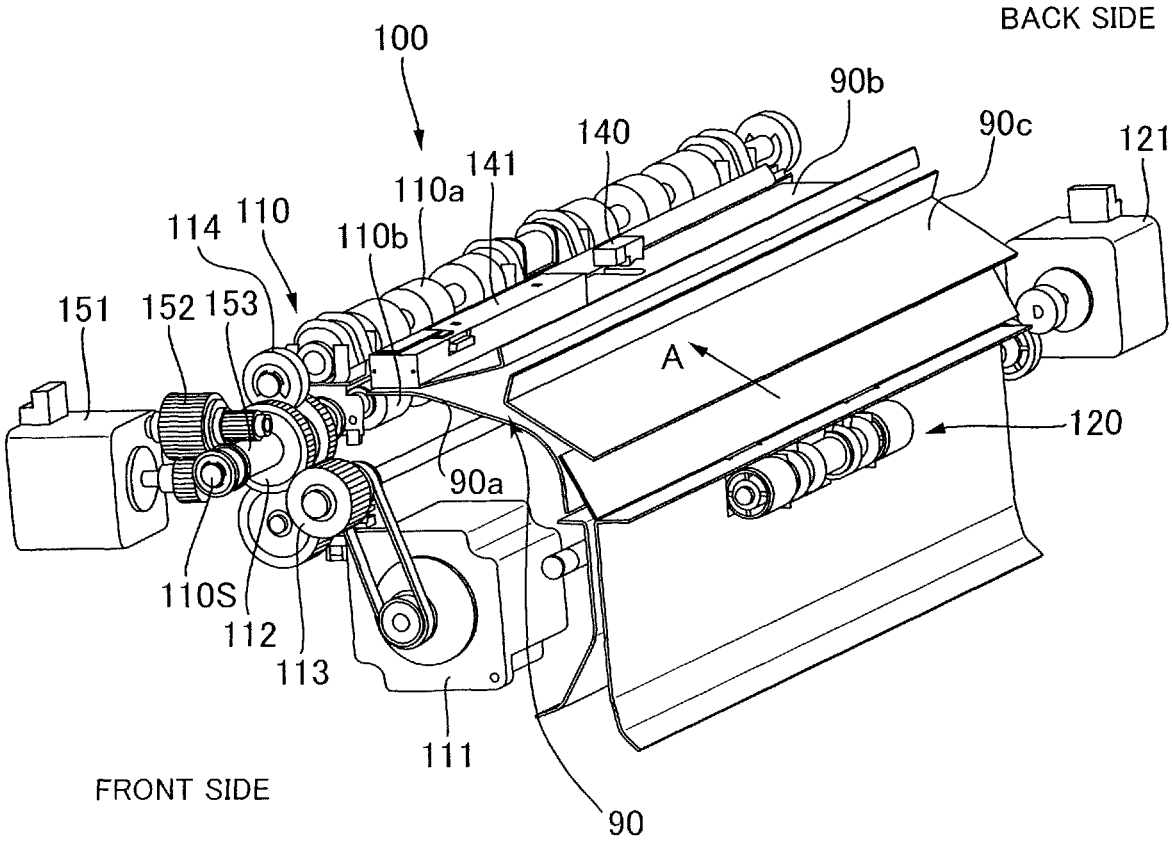
FIG. 2 is a perspective view of a sheet conveyance unit.

The sheet conveyance unit 100 is provided in a conveyance path 90 connecting the cassette sheet feed portion 1B, the manual sheet feed portion 64, and the transfer nip 1E as illustrated in FIGS. 1 and 2. The sheet conveyance unit 100 includes a registration roller pair 110 serving as a moving portion, a preregistration roller pair 120, a registration sensor 140 serving as a detection portion, and a contact image sensor: CIS 141 serving as a detection portion. The preregistration roller pair 120 is disposed upstream of the registration roller pair 110 in the sheet conveyance direction, and the registration sensor 140 and the CIS 141 are disposed between these roller pairs.

As illustrated in FIG. 2, the registration roller pair 110, which is a pair of rotatable members, include an upper roller 110*a* and a lower roller 110*b*. The lower roller 110*b* is fixed to a rotation shaft 1105. An input gear 112 is fixed to the rotation shaft 1105 and is driven by a first driving motor 111 via an idler gear 113. The preregistration roller pair 120 is driven by a second driving motor 121.

The rotation shaft 110S supports a rack 153 such that the rack 153 is relatively rotatable with respect to the rotation shaft 110S and is not movable in the shaft direction. The rack 153 receives a driving force from a shift motor 151 via a pinion gear 152 and shifts the rotation shaft 110S in the shaft direction. The upper roller 110*a* is shifted in the shaft direction together with the lower roller 110*b* as a result of a flange portion 114 integrally provided with the upper roller 110*a* being nipped by the input gear 112 of the lower roller 110*b*. The position of the sheet P in the width direction is corrected as a result of the registration roller pair 110 nipping the sheet P moving in the width direction and thereby moving the sheet P in the width direction.

The face width of the idler gear 113 is larger than the face width of the input gear 112. The face widths are set such that the engagement of these gears are kept and thus the registration roller pair 110 remains rotatable even in the case where the registration roller pair 110 and the input gear 112 has moved in the width direction.

The CIS 141 detects the position of an edge portion of the conveyed sheet P in the width direction. The position of the edge portion will be hereinafter referred to as an edge position. The control portion 200 calculates the amount of displacement between a designed standard position of the sheet, for example, a position at which the center of the conveyance path 90 in the width direction and the center of the sheet in the width direction match, and the edge position detected by the CIS 141, and causes the sheet conveyance unit 100 to shift by the calculated amount of displacement in the case where an image is to be formed on the first surface of the sheet. As a result of this, the position of the sheet P in the width direction and the position of transfer at the image forming portion 1C match, and thereby a high-quality product can be obtained.

The CIS 141 is disposed at a position displaced from the center of the conveyance path 90 to one side in the width direction. This is because it suffices for position correction of the sheet P as long as the edge position of one edge portion of the sheet P is detected. In addition, the CIS 141 is capable of detecting the edge position of each of a sheet P having the smallest width and a sheet P having the largest width among sheets of sizes allowed to be used in the printer 1. The CIS 141 is disposed as close to the registration roller pair 110 as possible in order not to lower the detection precision of the CIS 141.

In the sheet conveyance unit 100, the leading end of the conveyed sheet P is caused to abut the nip portion of the registration roller pair 110 that is stopped such that the sheet P is warped, and thereby the leading end of the sheet P is aligned with the nip portion and the skew of the sheet P is corrected. The sheet P is advanced by a predetermined amount by the preregistration roller pair 120 after the registration sensor 140 detects the leading end of the sheet P, and then is conveyed to the transfer nip 1E by the registration roller pair 110. Further, the gap between the CIS 141 and a lower guide 90*a* opposing the CIS 141 is kept to a certain interval, and a predetermined space is defined in the conveyance path 90 by the lower guide 90*a* and upper guides 90*b* and 90*c* such that the sheet P is capable of warping.

Figure 3:
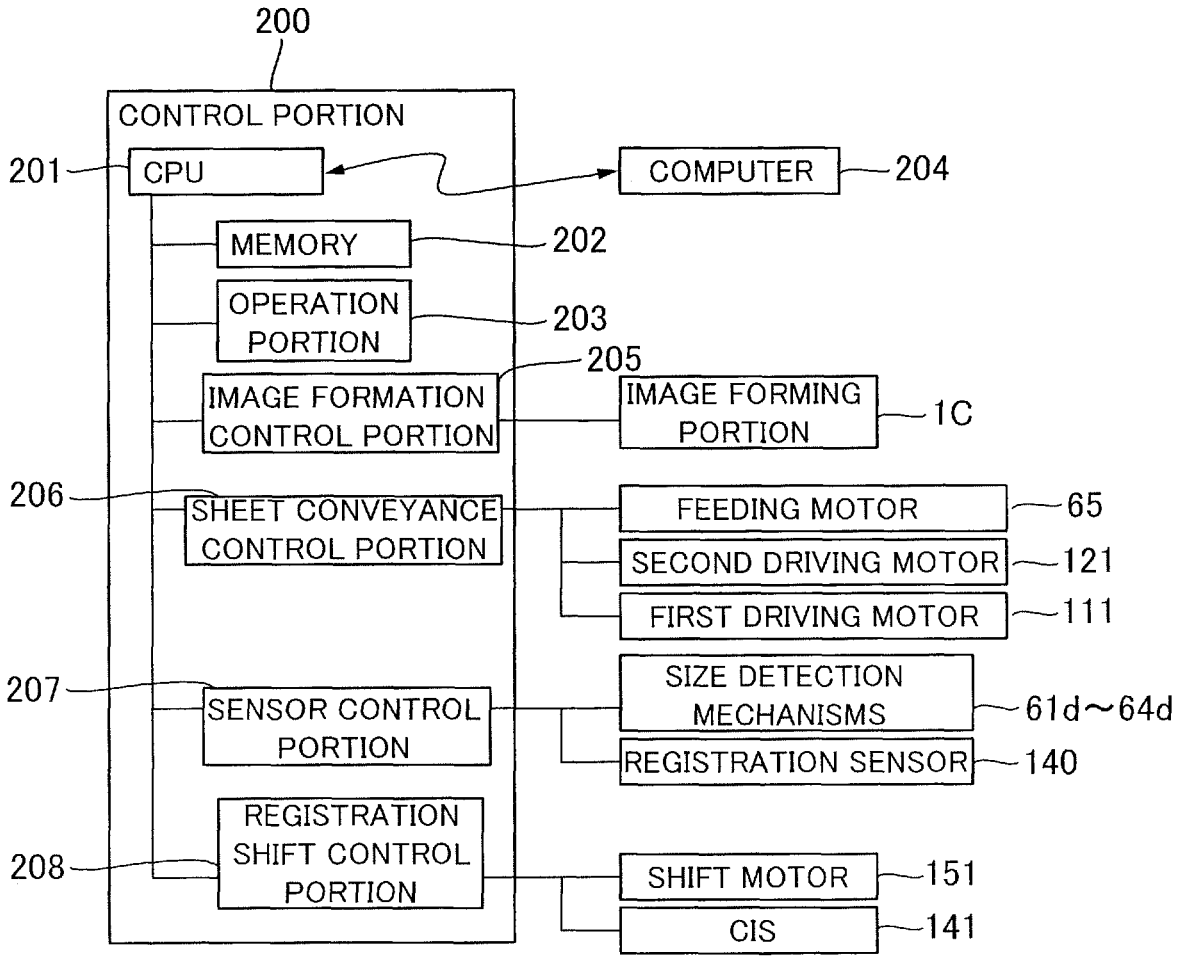
FIG. 3 is a block diagram of a control portion.

FIG. 3 is a control block diagram illustrating the control portion 200 of the printer 1. The control portion 200 includes a central processing unit: CPU 201, a memory 202, an operation portion 203, an image formation control portion 205, a sheet conveyance control portion 206, a sensor control portion 207, and a registration shift control portion 208. The CPU 201 realizes various processes performed by the printer 1 by executing a predetermined control program or the like. The memory 202 is constituted by, for example, a random access memory: RAM and a read only memory: ROM, and stores various programs and various data in a predetermined storage region. The operation portion 203 receives input of various information about sheets, execution and cancellation of jobs, and the like. Examples of the various information about sheets include sizes, grammages, and surface properties of sheets.

The image formation control portion 205 transmits an instruction to the image forming portion 1C including exposing units 13Y, 13M, 13C, 13K, and so forth and controls an image forming operation. The sheet conveyance control portion 206 transmits instructions to a feeding motor 65, the second driving motor 121, the first driving motor 111, and so forth and controls a conveyance operation of the sheet P. The feeding motor 65 drives the pickup rollers 61*a*, 62*a*, 63*a*, and the like. The sensor control portion 207 instructs the start and stop of detection performed by the sensors provided in the size detection mechanisms 61*d*, 62*d*, 63*d*, and 64*d*, the registration sensor 140, and the like, and receives detection results of these sensors.

The registration shift control portion 208 receives the detection result of the CIS 141, instructs the start and stop of driving of the shift motor 151 and the like, and controls a shifting operation of the registration roller pair 110 in the width direction. In addition, the CPU 201 is, for example, connectable to an external computer 204 via a network and capable of receiving various information about sheets, print jobs, and so forth from the computer 204.

Figure 4:
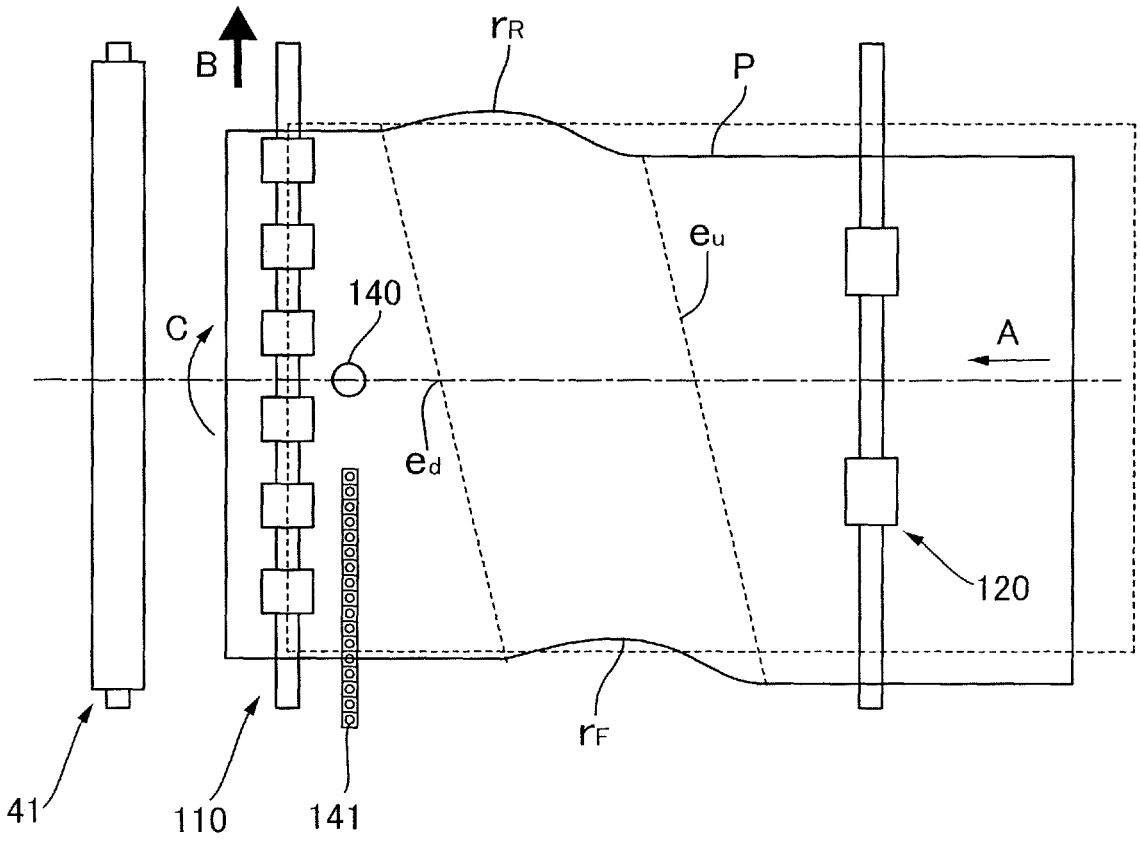
FIG. 4 is a schematic diagram illustrating a skew of a sheet caused by lateral shift correction.

Next, the upper limit value for the shifting operation by the registration roller pair 110 will be described. FIG. 4 illustrates a state in which the sheet warped for skew correction is shifted in an arrow B direction by the registration roller pair 110. The warped sheet is twisted as a result of the sheet being shifted in the arrow B direction. That is, a warp $r_F$ is formed in a portion of the sheet closer to the front of the apparatus, and a warp $r_R$ is formed in a portion of the sheet closer to the back of the apparatus. The warp $r_R$ is shifted downstream of the warp $r_F$ in the conveyance direction. As a result of this, inflection points $e_d$ and $e_u$ are formed in the sheet. The inflection points $e_d$ and $e_u$ are inclined with respect to the conveyance direction represented by an arrow A.

Due to the twisted warping formed in this way, a twist reaction force is applied to a position of the sheet at which the sheet is nipped by the registration roller pair 110, and thereby a force of turning in an arrow C direction is generated. As a result of this, in the case where the turning force generated by the twist reaction force surpasses the nipping force of the registration roller pair 110, the sheet is turned and is thus skewed. The turning force described above is proportional to the amount of warping formed by the skew correction and to the shift amount that is the distance in which the sheet is moved by the registration roller pair 110 in the width direction.

The amount of warping formed by the skew correction becomes larger as the amount of skew of the sheet is larger, and the amount of skew of the sheet is dependent on the shape of conveyance guides forming the conveyance path through which the sheet is conveyed and on the length of the conveyance path reaching the registration roller pair 110. Therefore, in the present exemplary embodiment, a different upper limit value of the shift amount is set in accordance with from which of the cassette sheet feed portion 1B, the manual sheet feed portion 64, and the duplex conveyance path 85 the sheet is conveyed to the sheet conveyance unit 100.

In particular, a manual feed conveyance path 91 between the pickup roller 64*a* and the registration roller pair 110 is short, and there is a case where the manual feed conveyance path 91 is shorter than the sheet conveyed to the manual feed conveyance path 91. In this case, the trailing end of the sheet still remains on the manual feed tray 64*b* with the leading end of the sheet nipped by the registration roller pair 110, so there is a possibility that the sheet interferes with the pair of side regulating plates 64*c* supported on the manual feed tray 64*b* illustrated in FIG. 1 when the sheet is shifted. Therefore, the upper limit value of the shift amount requires to be set to a small value in the case where the sheet is fed from the manual sheet feed portion 64. Conversely, since the duplex conveyance path 85 is long, it is desirable that the upper limit value of the shift amount is set to a large value in the case were an image is to be formed on the second surface of the sheet.

Figure 5:
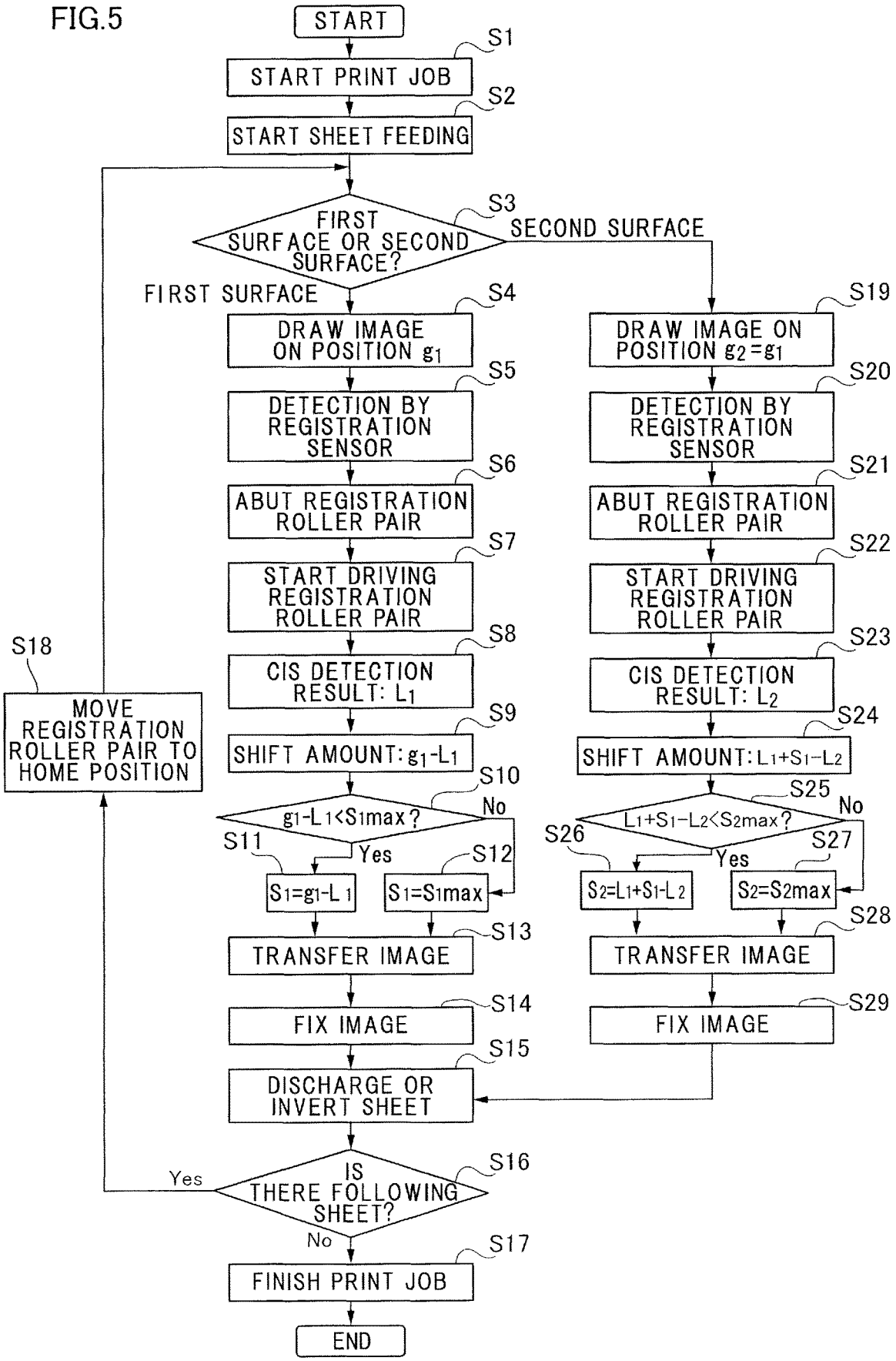
FIG. 5 is a flowchart illustrating a shifting process of a sheet.

Next, a shifting process of sheet P according to the present exemplary embodiment will be described with reference to a flowchart illustrated in FIG. 5. First, in step S1, a print instruction is input from the operation portion 203 or the computer 204, and the control portion 200 starts a print job. Via the operation portion 203 or the computer 204, a user is capable of instructing the number of copies to be printed and is also capable of designating a type of sheet to be used for the print. In addition, the control portion 200 receives sheet information of sheets housed in the cassettes 61, 62, and and supported on the manual feed tray 64*b* via the size detection mechanisms 61*d*, 62*d*, 63*d*, and 64*d*.

In step S2, the control portion 200 starts feeding a sheet P, and, in step S3, the control portion 200 determines which of printing on the first surface of the sheet P or printing on the second surface of the sheet P in the print job is to be performed. In the case where it is determined that the printing on the first surface of the sheet P is to be performed, the control portion 200 controls the image forming portion 1C to form a toner image on an image drawing position $g_1$ of the first surface determined in advance for the intermediate transfer belt 31 in step S4. More specifically, the control portion 200 controls the exposing units 13Y, 13M, 13C, and 13K such that electrostatic latent images are formed on respective photosensitive drums of the process cartridges 10Y, 10M, 10C, and 10K at positions corresponding to the image drawing position $g_1$. Then, the electrostatic latent images formed on the respective photosensitive drums are developed as toner images by developing units, and these toner images are transferred onto the intermediate transfer belt 31 by the primary transfer rollers 35Y, 35M, 35C, and 35K.

Figure 6A:
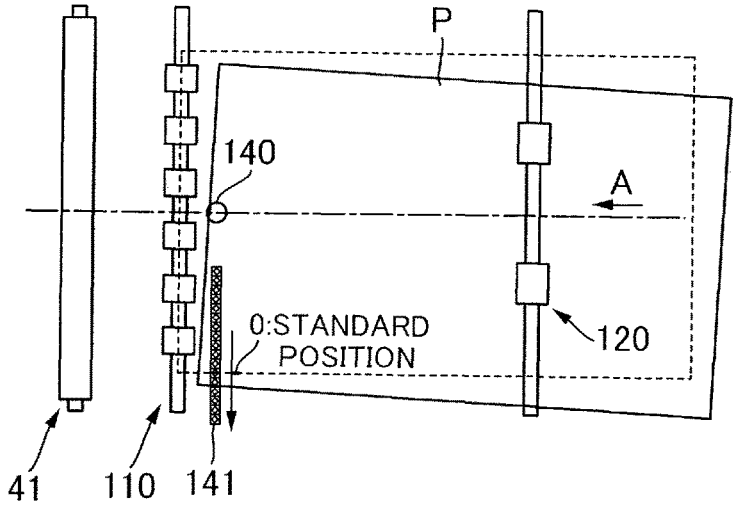
FIG. 6A is a plan view of a sheet in a skewed state.

Meanwhile, the sheet P is conveyed to the preregistration roller pair 120. Here, it is assumed that the conveyed sheet P is skewed as a result of rotating clockwise with respect to an arrow A direction, which is the conveyance direction, and is displaced to the left with respect to the arrow A direction as illustrated in FIG. 6A. To be noted, rectangles of dotted lines illustrated in FIGS. 6A to 7C schematically indicate a state in which the sheet P has been conveyed without being skewed or laterally displaced and the leading end of the sheet P is abutting the nip portion of the registration roller pair 110. The position of an edge portion of the sheet P in the width direction in this state is set as a zero point, and the direction to the left of the sheet P is set as a plus direction.

Figure 6B:
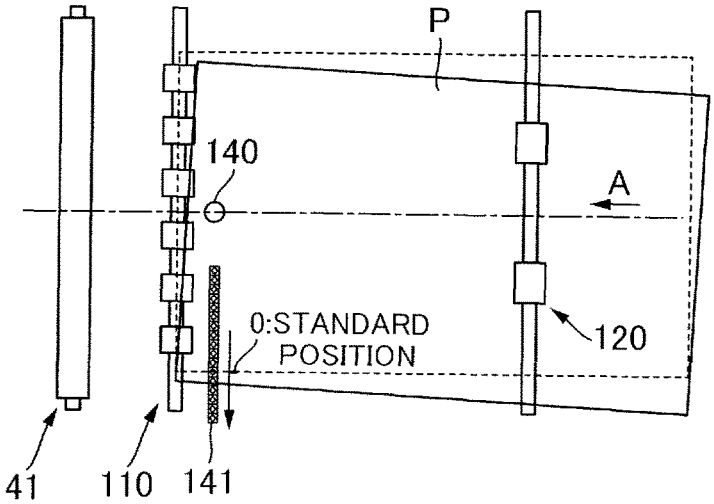
FIG. 6B is a plan view of the sheet whose skew is being corrected.
Figure 6C:
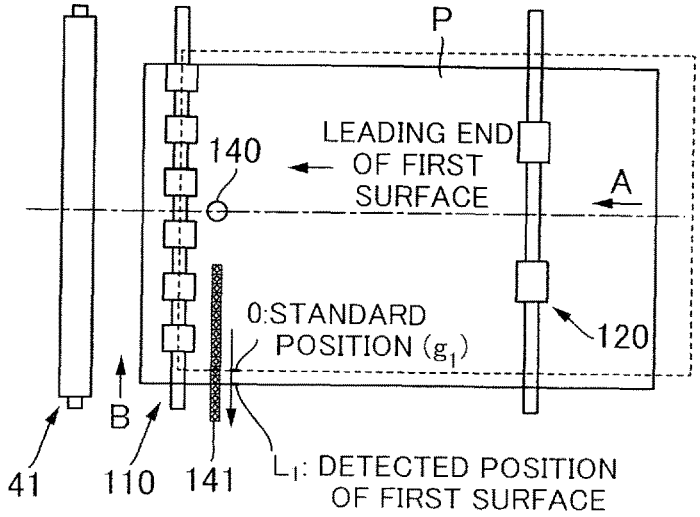
FIG. 6C is a plan view of the sheet being nipped by a registration roller pair.

Next, in step S5, the control portion 200 refers to the detection result of the registration sensor 140, and causes the preregistration roller pair 120 to advance the sheet P by a set advancing amount on the basis of the detection result. As a result of this, in step S6, the sheet P is caused to abut the registration roller pair 110 that is stopped, and a predetermined amount of warp is formed as illustrated in FIG. 6B. In this way, the skew of the sheet P is corrected, and, in step S7, the sheet P is nipped and conveyed by the registration roller pair 110 whose rotation has been started as illustrated in FIG. 6C.

After the skew of the sheet P is corrected, the CIS 141 detects the edge position of the sheet P serving as a first position in step S8, and the control portion 200 calculates a shift mount of the sheet P on the basis of the detection result $L_1$ in step S9. The shift amount of this case $g_1-L_1$ can be derived by subtracting the detection result $L_1$ of the CIS 141 from the image drawing position $g_1$. Then, in step S10, the control portion 200 determines whether the shift amount $g_1-L_1$ serving as a calculated value is smaller than an upper limit value $S_{1max}$, of the shift amount of the sheet P on the first surface of which an image is to be formed.

In the case where the calculated shift amount $g_1-L_1$ is smaller than the upper limit value $S_{1max}$, an actual shift amount $S_1$ becomes equal to the calculated shift amount $g_1-L_1$, that is, $S_1=g_1-L_1$ holds in step S11. By contrast, in the case where the calculated shift amount $g_1-L_1$ is equal to or greater than the upper limit value $S_{1max}$, the actual shift amount $S_1$ becomes equal to the upper limit value $S_{1max}$, that is, $S_1=S_{1max}$ holds in step S12, and the lateral displacement of the sheet P is not sufficiently corrected. That is, in this case, the sheet P is not moved to a standard position of a center standard and only moved to an intermediate position that is halfway to the standard position. Such a case often happens in the case where, for example, the sheet P is fed from the manual sheet feed portion 64. The actual shift amount $S_1$ is stored in, for example, the memory 202.

Figure 7A:
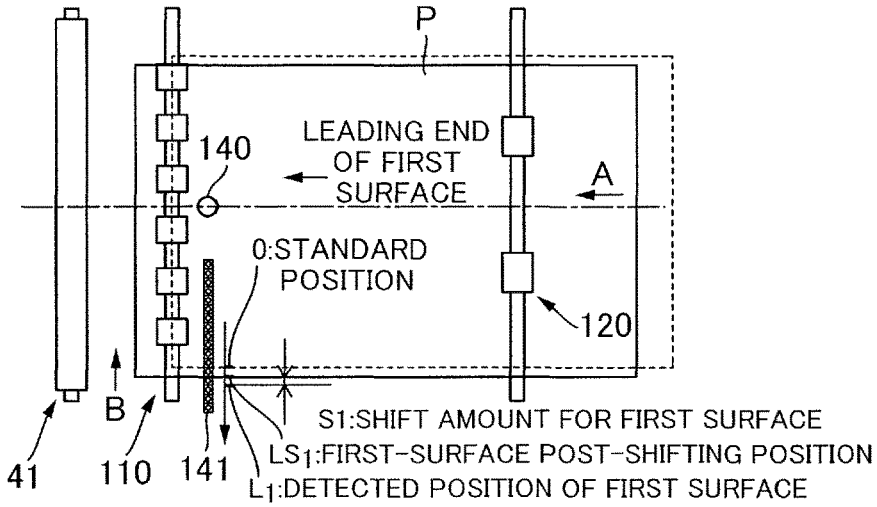
FIG. 7A is a plan view illustrating a state in which a shift amount for a first surface is equal to an upper limit value.

In the present exemplary embodiment, for simplicity, the image drawing position $g_1$ of the first surface is set as $g_1=0$, and a case where the calculated shift amount of the sheet P on the first surface of which an image is to be formed is equal to or greater than the upper limit value $S_{1max}$ is assumed. FIG. 7A illustrates a state in which the registration roller pair 110 is shifted by $S_{1max}$ in this case. Although it is naturally desirable that the sheet P is shifted to a position corresponding to the image drawing position $g_1=0$, the sheet P cannot be shifted by an amount equal to or greater than the upper limit value $S_{1max}$. Therefore, the position, that is, the lateral displacement of the sheet P in the width direction is not corrected further than correction to a first-surface post-shifting position $LS_1$ illustrated in FIG. 7A. As a result of this, the position of an image formed on the first surface of the sheet P positioned in the intermediate position is displaced from an ideal position.

Then, in step S13, the toner image on the intermediate transfer belt 31 is transferred at the transfer nip 1E onto the sheet P shifted by the sheet conveyance unit 100 by the shift amount S1, and, in step S14, the toner image is melted and fixed by the fixing unit 5.

In step S15, in the case where the print job is a single-sided printing job, the sheet P onto which the toner image is fixed is discharged onto the discharge tray 66, and, in the case where the print job is a duplex printing job, the sheet P is inverted for image formation on the second surface. Next, the control portion 200 determines whether there is a following sheet in step S16. In the case where the control portion 200 determines that there is no following sheet, the print job is finished in step S17. In the case where the control portion 200 determines that there is a following sheet, the control portion 200 causes the registration roller pair 110 to move back to a home position in step S18. The home position is a center position in the present exemplary embodiment. Then, the process returns to step S3.

In the case where the control portion 200 determines that the printing on the second surface in the print job is to be performed in step S3, the control portion 200 controls the image forming portion 1C to form a toner image on the second image drawing position $g_2$ of the second surface that is the same position in the width direction as the first image drawing position $g_1$ of the first surface with respect to the intermediate transfer belt 31 in step S19, that is, $g_2=g_1$ holds. That is, the center of the image for the second surface to be formed on the intermediate transfer belt 31 in the width direction coincides with the center of the image for the first surface formed on the intermediate transfer belt 31 in the width direction. The skew correction operation from step S20 to step S22 by the registration roller pair 110 for the sheet P on the second surface of which an image is to be formed is the same as that for the sheet P on the first surface of which an image is to be formed, and thus the description thereof is omitted.

Figure 7B:
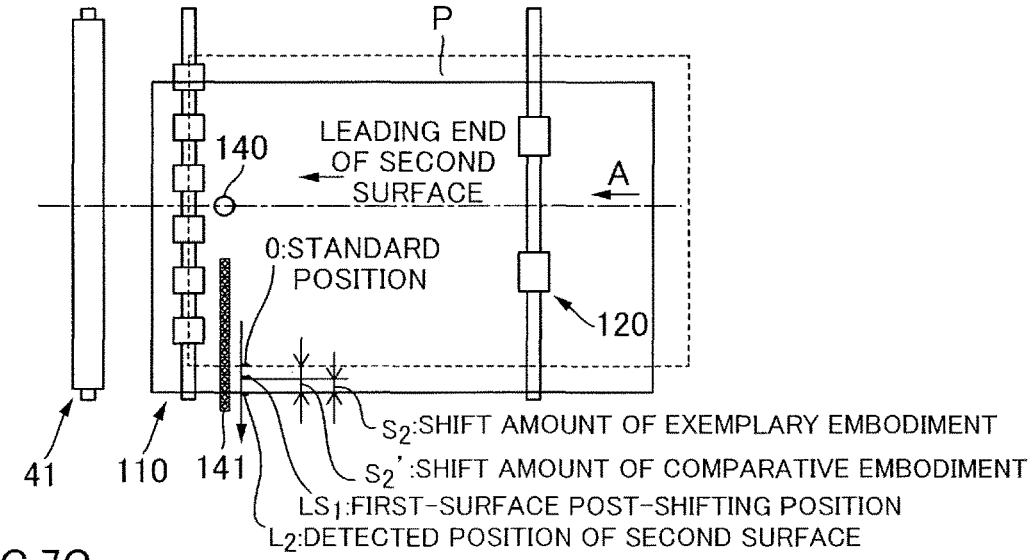
FIG. 7B is a plan view illustrating a state in which an edge portion of a second surface of a sheet is detected.

After the skew of the sheet P is corrected, the CIS 141 detects the edge position of the second surface serving as a second position in step S23, and the control portion 200 calculates a shift mount of the sheet P on the basis of the detection result $L_2$ as illustrated in FIG. 7B.

Here, a comparative embodiment illustrated in FIGS. 7B and 7C in which the sheet P is sifted to the standard position 0 will be described. In this comparative embodiment, a shift amount $S_2'$ of the second surface is $S_2'=g_2-L_2$, and the position of the image on the second surface in the width direction can be set to the ideal position by shifting the sheet P to the standard position. However, in the case where the image on the first surface is displaced from the ideal position as described above, the images on the first surface and the second surface of the sheet P are relatively displaced from each other in the width direction even if the image on the second surface is formed at the ideal position.

Therefore, in the present exemplary embodiment, the sheet P is shifted by an amount of displacement, that is, a difference, between the first-surface post-shifting position $LS_1=L_1+S_1$ and the detected position $L_2$ of the second surface. That is, the shift amount for the sheet P on the second surface of which an image is to be formed is calculated as $L_1+S_1-L_2$ in step S24, and the control portion 200 determines whether the calculated shift amount $L_1+S_1-L_2$ is smaller than an upper limit value $S_{2max}$ of the shift amount for the second surface in step S25.

In the case where the calculated shift amount $L_1+S_1-L_2$ is smaller than the upper limit value $S_{2max}$, an actual shift amount $S_2$ becomes equal to the calculated shift amount $L_1+S_1-L_2$, that is, $S_2=L_1+S_1-L_2$ holds in step S26. By contrast, in the case where the calculated shift amount $L_1+S_1-L_2$ is equal to or greater than the upper limit value $S_{2max}$, the actual shift amount $S_2$ becomes equal to the upper limit value $S_{2max}$, that is, $S_2=S_{2max}$ holds in step S27. Since it is assumed that the upper limit value $S_{2max}$ of the shift amount for the second surface is relatively greater than the upper limit value $S_{1max}$ of the shift amount for the first surface, the case where the calculated shift amount for the second surface exceeds the upper limit value $S_{2max}$ in a shifting operation of the sheet P on the second surface of which an image is to be formed is practically rare. In the present exemplary embodiment, the actual shift amount $S_1$ for the first surface and the actual shift amount $S_2$ for the second surface are negative values.

Figure 7C:
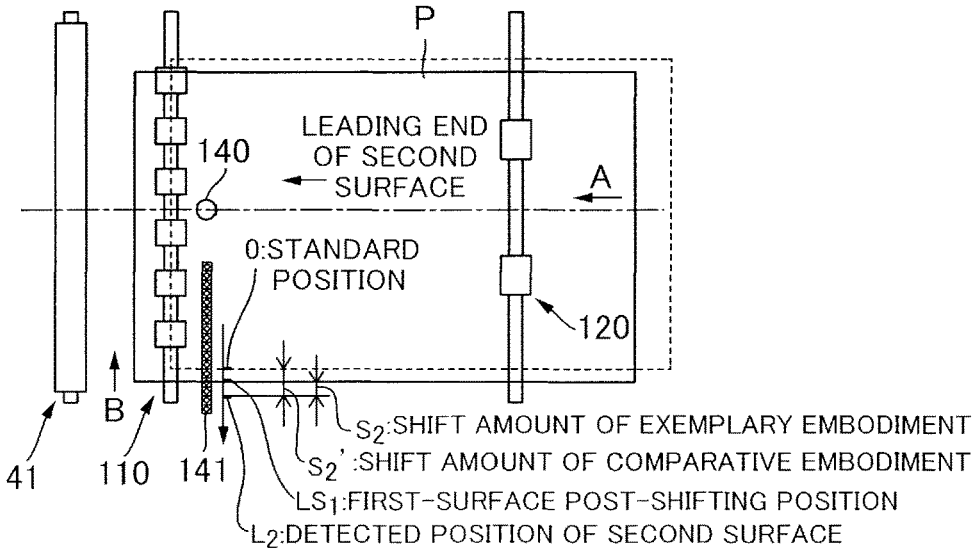
FIG. 7C is a plan view illustrating a difference in a shift amount between the exemplary embodiment and a comparative embodiment.

As a result of the lateral displacement of the sheet P for the second surface being corrected in this way, the edge position of the second surface of the sheet P coincides with the first-surface post-shifting position $LS_1$, that is, the edge position of the first surface of the sheet P as illustrated in FIG. 7C. That is, also in a process of image formation on the second surface, the sheet P is moved to the intermediate position as in a process of image formation on the first surface. In other words, in the process of image formation on the second surface of the sheet P, the control portion 200 moves, based on the detection result of the CIS 141, the registration roller pair 110 in the width direction such that the center of the image formed on the first surface in the width direction coincides with the center of the image to be formed on the second surface in the width direction. The steps S28, S29, and S15 to S17 after this step including image transfer are the same processes as in the printing on the first surface, and thus the description thereof is omitted.

Figure 8A:
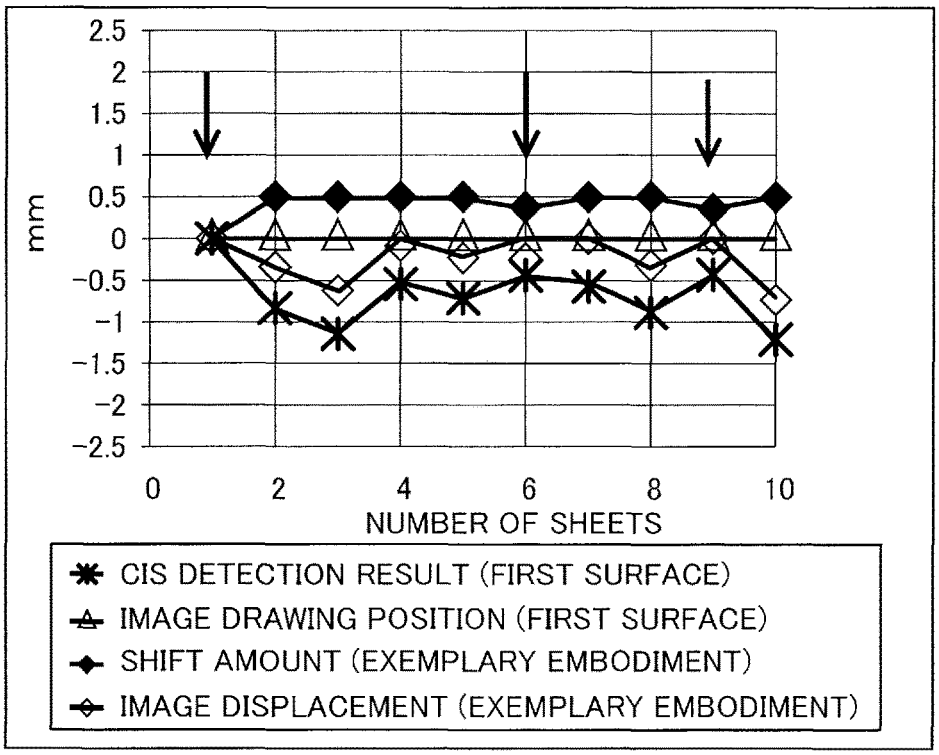
FIG. 8A is a graph in which each piece of data of the first surface obtained in the case where consecutive duplex sheet feeding is performed in the exemplary embodiment is plotted.
Figure 8B:
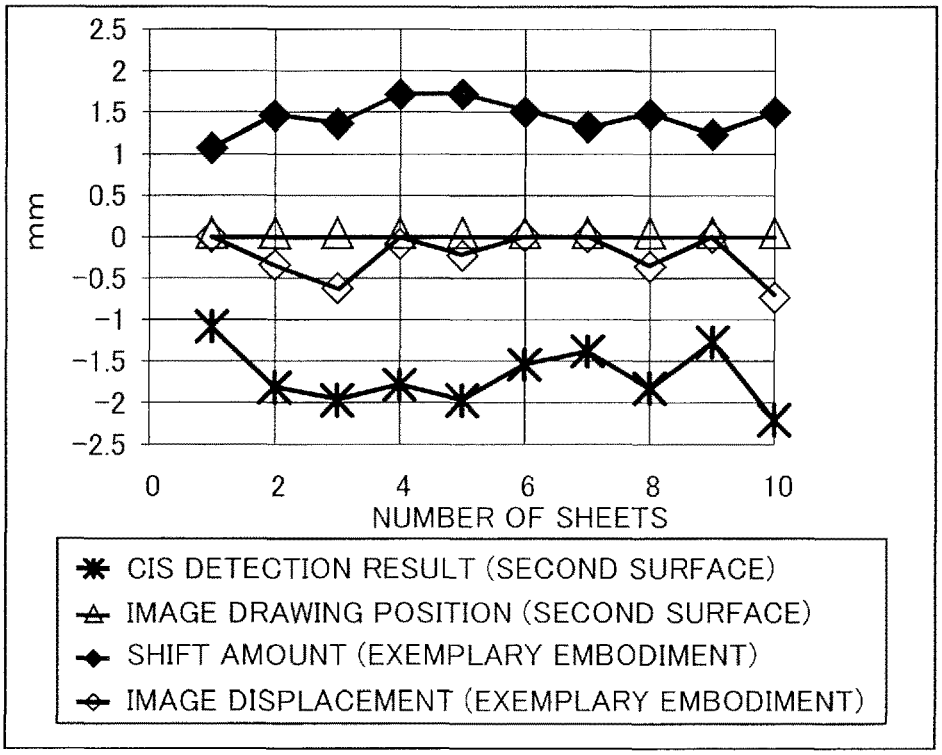
FIG. 8B is a graph in which each piece of data of the second surface obtained in the case where consecutive duplex sheet feeding is performed in the exemplary embodiment is plotted.

The advantageous effect of the present exemplary embodiment achieved in the case where ten sheets are consecutively fed in the printer 1 will be described with reference to FIGS. 8A to 10 in comparison with the comparative embodiment. In FIG. 8A, the detection results of CIS 141, the image drawing position, the actual shift amount of the sheet P, and the amount of displacement of the image formed on the sheet P from the standard position are plotted for the first surface. In FIG. 8B, the detection results of CIS 141, the image drawing position, the actual shift amount of the sheet P, and the amount of displacement of the image formed on the sheet P from the standard position are plotted for the second surface.

In the present exemplary embodiment, the upper limit values $S_{1max}$ and $S_{2max}$ of the shift amounts for the first surface and the second surface are respectively set as $S_{1max}$: ±0.5 mm and $S_{2max}$: ±2.5 mm, and the image drawing positions for the first surface and the second surface are set as the same, that is, $g_1=g_2$ holds. The detection results of the CIS 141 for the first surface vary from −0.1 mm of the first sheet to −1.2 mm of the tenth sheet. Among these results, results that satisfy the condition of $L_1<S_{1max}$ are the results for the first, sixth, and ninth sheet indicated by arrows in FIG. 8A. The lateral displacement of these sheets is corrected to the ideal position, and thus the amounts of image displacement thereof are zero.

For the other sheets, the calculated shift amounts are greater than the upper limit value $S_{1max}$, and thus the actual shift amount $S_1$ is fixed to 0.5 mm. As a result of this, the amount of displacement from the standard position is largest for the tenth sheet, and the image thereon is displaced by −0.7 mm. For the second surface, the shift amount $S_2$ is not set to the same value as the detection result of the CIS 141 and set as $S_2=L_1+S_1-L_2$ as described above, and thus the value of amount of image displacement has the same tendency as the result for the first surface.

Figure 9A:
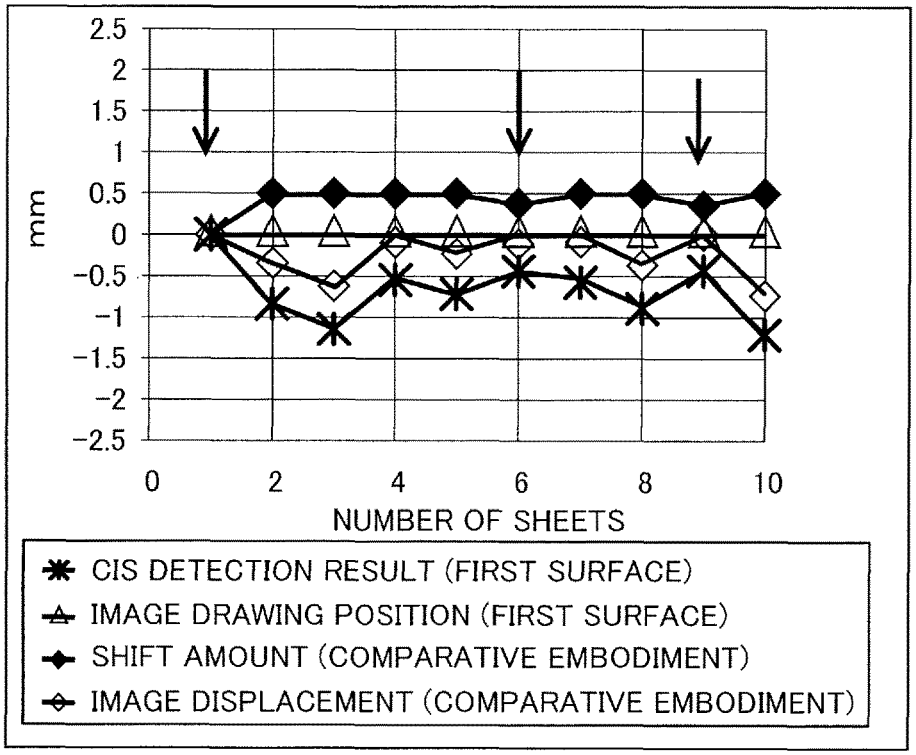
FIG. 9A is a graph in which each piece of data of the first surface obtained in the case where consecutive duplex sheet feeding is performed in the comparative embodiment is plotted.
Figure 9B:
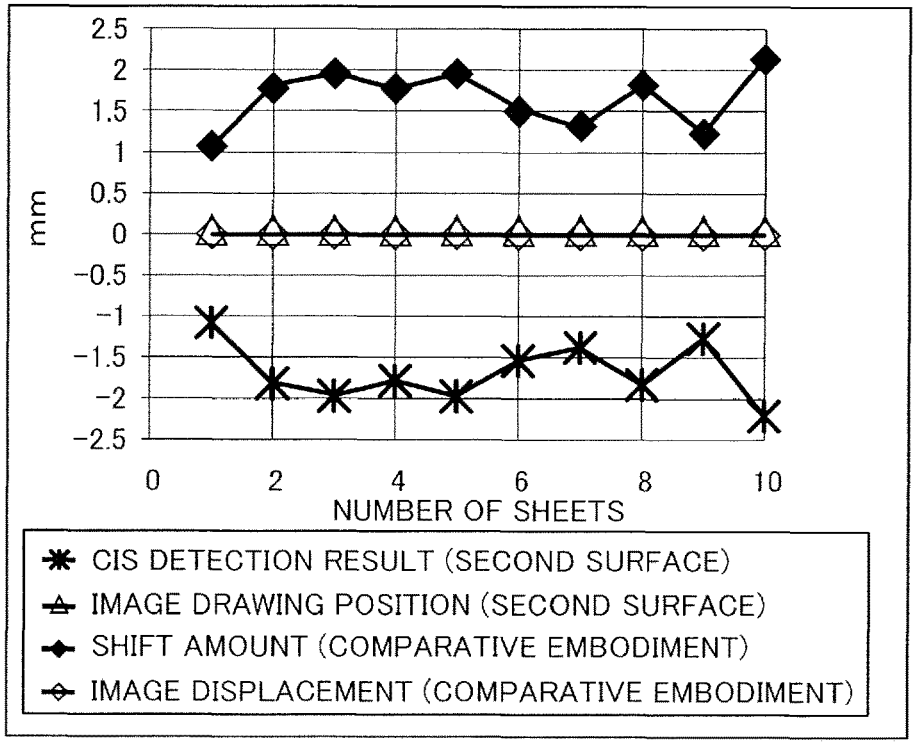
FIG. 9B is a graph in which each piece of data of the second surface obtained in the case where consecutive duplex sheet feeding is performed in the comparative embodiment is plotted.

The results of the comparative embodiment will be described with reference to the result for the first surface illustrated in FIG. 9A and the result for the second surface illustrated in FIG. 9B. The upper limit value $S_{1max}$ of the shift amount and the image drawing positions $g_1$ and $g_2$ are set in the same manner as what has been described for the present exemplary embodiment. The control for lateral displacement correction for the first surface in the comparative embodiment is the same as the control for the lateral displacement correction for the first surface in the present exemplary embodiment. In the control for the lateral displacement correction for the second surface in the comparative embodiment, the lateral displacement is corrected to the ideal position based on the detection result of the CIS 141. Therefore, the amount of image displacement in the second surface is zero for all ten sheets. In addition, it can be seen that the shift amount of the sheet on the second surface of which an image is to be formed in the comparative embodiment is larger than in the present exemplary embodiment because the lateral displacement of the sheet is corrected to the ideal position.

Figure 10:
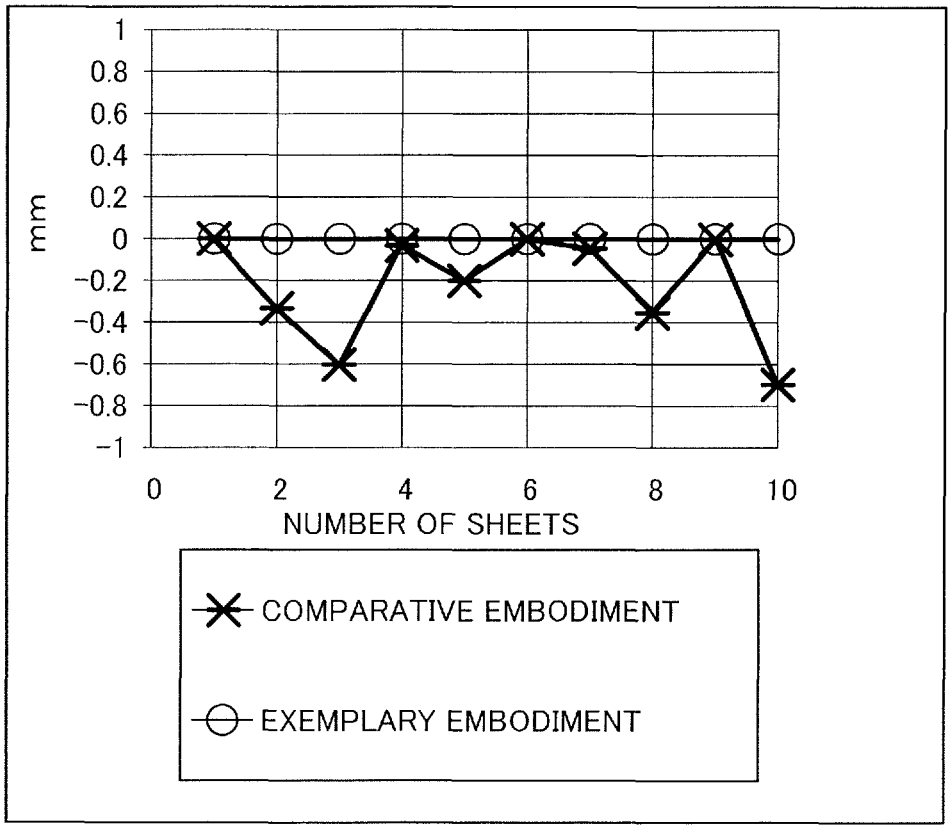
FIG. 10 is a graph illustrating displacement between images formed on the first surface and the second surface in the exemplary embodiment and the comparative embodiment.

FIG. 10 illustrates results of amount of displacement of images between the first surface and the second surface of the sheet for the present exemplary embodiment and the comparative embodiment described above. According to the present exemplary embodiment, the amount of displacement of images between the first surface and the second surface is greatly improved compared with the comparative embodiment, and it can be seen that the amount of displacement is almost zero for all ten sheets. Thus, according to the present exemplary embodiment, the amount of displacement of images between the first surface and the second surface can be reduced, and a high-quality printed product can be obtained. In addition, since upper limit values are set for the shift amount of the sheet in forming images on the first surface and the second surface, the amount of shifting of the sheet by the sheet conveyance unit 100 can be reduced, and the skew of the sheet can be reduced. Moreover, as a result of the shift amount of the registration roller pair 110 being reduced, the time for the shifting operation and the operation of moving back to the home position can be shortened, and the productivity can be improved.

In the exemplary embodiment described above, the upper limit value $S_{1max}$ for the first surface is set to ±0.5 mm, but the upper limit value is not limited to this example. For example, the upper limit value $S_{1max}$ may be set to a larger value depending on a feed unit from which the sheet is fed, or, conversely, the upper limit value $S_{1max}$ may be set as $S_{1max}=0$ such that the sheet is not shifted in the width direction. For example, in the case where the sheet P is fed from the manual sheet feed portion 64, the upper limit value of the shift amount may be set to zero. The present exemplary embodiment is applicable to either case.

In addition, in the exemplary embodiment described above, the image drawing position $g_2$ for the second surface is set to be the same as the image drawing position $g_1$ for the first surface, that is, $g_2=g_1$ holds, but the image drawing position is not limited to this example. For example, after an image is transferred and fixed onto the first surface of the sheet P, the sheet P is laterally displaced in the width direction before being conveyed to the sheet conveyance unit 100 again through the duplex conveyance path 85. There is a case where the amount of this displacement has a certain tendency as an amount unique to the apparatus body such as alignment displacement of the duplex conveyance path 85. That is, the shift amount $S_2$ of the sheet on the second surface of which an image is to be formed can be reduced by the CIS 141 estimating an amount of displacement d when detecting the edge position of the second surface and reflecting the amount of displacement d on the image drawing position for the second surface. In this case, the image drawing position $g_2$ for the second surface may be set as $g_2=g_1+d$.

Figure 11:
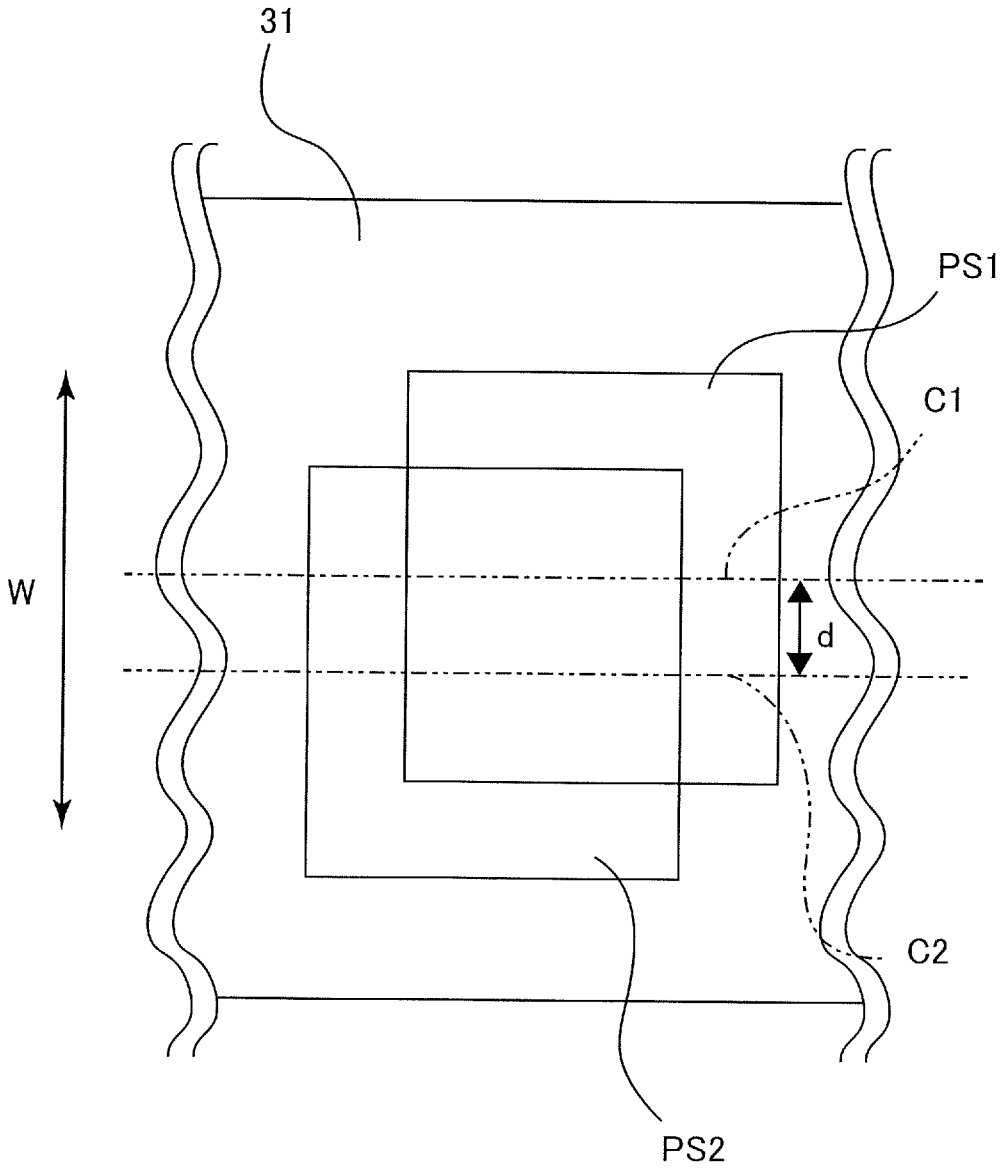
FIG. 11 is a schematic diagram illustrating a positional relationship between a toner image on a first surface and a toner image on a second surface in a modification embodiment.

FIG. 11 illustrates the positional relationship between a toner image PS1 of the first surface and a toner image PS2 of the second surface that are formed on the intermediate transfer belt 31 according to a modification embodiment. Practically, the toner image PS1 and the toner image PS2 will not be formed on the intermediate transfer belt at the same time. However, the toner image PS1 and the toner image PS2 are both illustrated in FIG. 11 for description. The toner image PS1 is formed on the intermediate transfer belt 31 at the image drawing position $g_1$, and the toner image PS2 is formed on the intermediate transfer belt 31 at the image drawing position $g_2$. At this time, a center C2 of the toner image PS2 in a width direction W is displaced from a center C1 of the toner image PS1 in the width direction W by the amount of displacement d in the width direction W.

Although the CIS 141 detects the edge position of the sheet before the lateral displacement of the sheet is corrected in the present exemplary embodiment, the embodiment is not limited to this. That is, the CIS 141 may detect the edge position of the sheet P immediately after the lateral displacement of the sheet P is corrected by the sheet conveyance unit 100 or immediately before the trailing end of the sheet P passes by the CIS 141. These edge positions are substantially the same as the edge position of the sheet positioned in the intermediate position described above, and the shift amount of the sheet for the second surface may be determined based on the result of this detection. In addition, although the CIS 141 is disposed upstream of the registration roller pair 110 in the conveyance direction in the exemplary embodiment, the CIS 141 may be disposed downstream of the registration roller pair 110. In addition, a charge coupled device: CCD sensor or a complementary metal oxide semiconductor: CMOS sensor may be used in place of the CIS 141, and the position of an edge portion of the sheet in the width direction does not have to be detected if the position of the sheet in the width direction can be detected by such a sensor.

Further, a system of causing the sheet to abut a shutter member provided upstream of the registration roller pair 110 in the conveyance direction may be employed in place of the system of causing the sheet to abut the registration roller pair 110 to correct the skew thereof.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-027455, filed Feb. 16, 2016, which is hereby incorporated by reference herein in its entirety.

What is claimed is:

1. An image forming apparatus comprising:

an image forming portion configured to form an image on a sheet at an image forming position;

a moving portion provided upstream of the image forming position in a conveyance direction in which the sheet is conveyed and configured to move the sheet toward a predetermined position in a width direction perpendicular to the conveyance direction;

a re-conveyance portion configured to invert the sheet having the image formed on a first surface of the sheet by the image forming portion such that the first surface and a second surface of the sheet change places and configured to convey the sheet to the image forming position again;

a detector configured to detect a first position and a second position, the first position being a position of an edge portion, in the width direction, of the sheet at a position upstream of the image forming position in the conveyance direction in a case where the image is to be formed on the first surface, the second position being a position of an edge portion, in the width direction, of the sheet at a position upstream of the image forming position in the conveyance direction in a case where the image is to be formed on the second surface; and a controller configured to (1) control the moving portion to move the sheet, in an image formation process on the first surface, to the predetermined position in the width direction and control the moving portion to move the sheet, in an image formation process on the second surface, in the width direction based on the second position detected by the detector in a case where a difference between the standard predetermined position and the first position in the width direction is equal to or smaller than a predetermined value, and (2) control the moving portion to move the sheet, in the image formation process on the first surface, by the predetermined value in the width direction and control the moving portion to move the sheet, in the image formation process on the second surface, in the width direction based on the first and second positions detected by the detector in a case where the difference between the predetermined position and the first position in the width direction is larger than the predetermined value.

2. The image forming apparatus according to claim 1, wherein the predetermined value is 0.5 mm.

3. The image forming apparatus according to claim 1, wherein a distance by which the moving portion moves the sheet in the width direction in the image formation process on the first surface is smaller than a distance by which the moving portion moves the sheet in the width direction in the image formation process on the second surface.

4. The image forming apparatus according to claim 1, wherein the moving portion is configured to move the sheet in the width direction while nipping the sheet.

5. The image forming apparatus according to claim 1, wherein the controller is configured to control the moving portion to move the sheet, in the image formation process on the second surface, in the width direction such that a position of a center of the sheet in the width direction at the image forming position when the image is formed on the first surface and a position of a center of the sheet in the width direction at the image forming position when the image is formed on the second surface coincide.

6. The image forming apparatus according to claim 1, wherein the controller is configured to control the moving portion to move the sheet, in the image formation process on the second surface, in the width direction such that a position of a center of the image, in the width direction, to be formed on the second surface at the image forming position coincides with a position of a center of the image, in the width direction, which has been formed in the image formation process on the first surface at the image forming position.

7. The image forming apparatus according to claim 1, further comprising:

an apparatus body in which the image forming portion is provided;

a sheet cassette configured to be attached to the apparatus body and to be drawn out from the apparatus body and to support the sheet; and a manual feed tray provided on the apparatus body and on which the sheet is to be manually stacked, wherein the controller sets the predetermined value to zero in a case where the sheet is fed from the manual feed tray.

8. The image forming apparatus according to claim 7, wherein the controller is configured to control the moving portion to move the sheet in the image formation process on the second surface such that the edge portion of the sheet coincides with the first position in the width direction in a case where the sheet is fed from the manual feed tray.

9. The image forming apparatus according to claim 7, wherein the controller is configured to control the moving portion to move the sheet on the second surface of which an image is to be formed by an amount based on a difference between the first position and the second position detected by the detector in the width direction in a case where the sheet is fed from the manual feed tray.

10. The image forming apparatus according to claim 1, wherein the image forming portion includes an image bearing member configured to bear an image and a transfer portion configured to transfer the image born by the image bearing member onto the sheet, and a center of an image for the second surface to be formed on the image bearing member in the width direction coincides with a center of an image for the first surface to be formed on the image bearing member in the width direction.

11. The image forming apparatus according to claim 1, wherein the image forming portion includes an image bearing member configured to bear an image and a transfer portion configured to transfer the image born by the image bearing member onto the sheet, and a center of an image for the second surface to be formed on the image bearing member in the width direction is displaced in the width direction from a center of an image for the first surface to be formed on the image bearing member in the width direction.

12. The image forming apparatus according to claim 1, wherein the detector is disposed upstream of the moving portion in the conveyance direction.

13. The image forming apparatus according to claim 1, wherein the moving portion includes a pair of rotatable members configured to correct a skew of a sheet whose leading end abuts the pair of rotatable members.

14. The image forming apparatus according to claim 1, wherein the predetermined position is a position of the sheet at which a center of the sheet in the width direction coincides with a center of a conveyance path in the width direction, the conveyance path being configured to guide the sheet in the conveyance direction.

15. The image forming apparatus according to claim 14, wherein the image forming portion comprises an image bearing member configured to bear an image on an image bearing area and a transfer portion configured to transfer the image born by the image bearing member onto the sheet, and wherein a center of the image bearing area coincides with the center of the conveyance path.

* * * * *